US006034638A

United States Patent [19]

Thiel et al.

[11] Patent Number: 6,034,638

[45] Date of Patent: Mar. 7, 2000

[54] ANTENNAS FOR USE IN PORTABLE COMMUNICATIONS DEVICES

[75] Inventors: David V. Thiel, Cornubia; Steven G. O'Keefe, Chambers Flat; Jun W. Lu, Wishart, all of Australia

[73] Assignee: Griffith University, Queensland, Australia

[21] Appl. No.: 08/557,031

[22] PCT Filed: May 20, 1994

[86] PCT No.: PCT/AU94/00261

§ 371 Date: Mar. 14, 1996

§ 102(e) Date: Mar. 14, 1996

[87] PCT Pub. No.: WO94/28595

PCT Pub. Date: Dec. 8, 1994

[30] Foreign Application Priority Data

May 27, 1993 [AU] Australia ..... PL 9043

[51] Int. Cl.[7] ..... H01Q 1/24

[52] U.S. Cl. ..... 343/702; 343/815; 343/841; 343/873

[58] Field of Search ..... 343/702, 785, 343/700 MS, 790, 815, 818, 841, 851, 833, 834, 876, 872, 873

[56] References Cited

U.S. PATENT DOCUMENTS

| | | | |
|---|---|---|---|
| 3,268,896 | 8/1966 | Spitz | 343/785 |
| 3,541,567 | 11/1970 | Francis et al. | 343/873 |
| 3,560,978 | 2/1971 | Himmel et al. | 343/833 |
| 3,725,938 | 4/1973 | Black et al. | 343/833 |
| 4,123,759 | 10/1978 | Hines et al. | 343/854 |
| 4,170,759 | 10/1979 | Stimple et al. | 343/876 |
| 4,356,492 | 10/1982 | Kaloi | 343/700 MS |
| 4,367,474 | 1/1983 | Schaubert et al. | 343/700 MS |
| 4,379,296 | 4/1983 | Farrar et al. | 343/700 MS |
| 4,414,550 | 11/1983 | Tresselt | 343/700 MS |
| 4,631,546 | 12/1986 | Dumas et al. | 343/833 |
| 4,700,197 | 10/1987 | Milne | 343/837 |
| 4,800,392 | 1/1989 | Garay et al. | 343/700 MS |
| 5,075,691 | 12/1991 | Garay et al. | 343/830 |
| 5,243,358 | 9/1993 | Sanford et al. | 343/700 MS |
| 5,338,896 | 8/1994 | Danforth | 343/702 |
| 5,373,304 | 12/1994 | Nolan et al. | 343/841 |
| 5,507,012 | 4/1996 | Luxon et al. | 343/841 |

FOREIGN PATENT DOCUMENTS

| | | |
|---|---|---|
| 214806 | 8/1986 | European Pat. Off. . |
| 588271 | 9/1993 | European Pat. Off. . |
| 2216726 | 3/1989 | United Kingdom . |
| 2227370 | 11/1989 | United Kingdom . |

*Primary Examiner*—Don Wong
*Assistant Examiner*—Tan Ho
*Attorney, Agent, or Firm*—Jenkins & Wilson, P.A.

[57] ABSTRACT

In one embodiment, an antenna has four equally spaced monopole elements mounted in a symmetric array on the outer surface of a solid cylinder structure. The cylinder has a high dielectric constant, and extends from a conductive ground plane. The monopole elements can be switched by switching elements so that one or more is active, with the others acting as parasitic directors/reflectors being connected commonly to ground or left in an open circuit condition to be effectively transparent.

22 Claims, 9 Drawing Sheets

ANTENNAS FOR USE IN PORTABLE COMMUNICATIONS DEVICES

TECHNICAL FIELD

This invention relates to antenna arrangements for use in portable communications devices. Embodiments thereof specifically relate to physically small antennas, directional antennas, and to electronically steerable antennas.

Portable or hand-held communications devices are to be taken to include cellular mobile telephones, radio pagers and two-way radios (walkie-talkies). Other applications for antennas embodying the invention are to be found in geophysical (such as ground probing radar and borehole tomography) and other radar systems (such as anti-collision radar for moving vehicles).

DESCRIPTION OF THE PRIOR ART

Antennas are used in a wide variety of applications both as transmitters and receivers of electromagnetic energy. In many of these applications it is desirable to maximise the directivity of the antenna. In the prior art this has been achieved by techniques such as the use of reflector screens (e.g. parabolic dish antennas, corner reflectors), reflector elements (e.g. curtain arrays, Yagi parasitic elements), slow wave structures (e.g. Yagi antennas) and multiple antenna arrays.

By way of a specific example, in mobile cellular telecommunications it is desirable to improve the directivity of the antenna of a mobile handset for reason of reducing the power consumption, hence lessening demand on the battery. Improved directivity also has benefit in increasing the range of mobile cellular telephones in relation to a cell site, and in reducing the interference between adjacent cells.

There also presently are concerns about the safety of mobile cellular telephones on users. Human tissue is a very good conductor of electricity, even at high frequencies, and it has been suggested that brain tumors may occur with prolonged use of such devices for reason of the antenna being very close to the user's skull resulting in very high strength electromagnetic fields concentrated about the antenna penetrating the skull and damaging brain tissue. The IEEE has published Technical Standard No. C95.3 in relation to recommend maximum exposure to electromagnetic radiation received by, and propagated from, antennae. A directional antenna tends to minimise the radiation directed towards the user, and from this point of view is most desirable.

Shielding too is an established technique to reduce exposure. There is a trade-off, however, in that the proximity of a shield to an antenna can adversely affect the efficiency of the antenna. As a rule of thumb, a shield must be located at least ¼ wavelength away from the antenna.

In other applications, such as geophysical systems, severe deep fading caused by multipath interference occurs when two signals are incident on the same antenna with approximately equivalent field strengths and with approximately 180° phase difference. A steerable directional antenna can minimise the effect of such fading.

An example of an antenna structure that has consideration of the issues of directivity and steerability is that disclosed in U.S. Pat. No. 4,700,197 issued to Robert Milne.

Size too is an important consideration, particularly as electronic communications devices become ever more miniaturized. To some extent the reduction of the size of antennas is antagonistic to achieving improved directivity.

In free space, the distance between radiating elements/reflectors is a substantial part of one free space wavelength of the radiation in air. This means the antennas may be relatively large in more than one direction if directionality is required. Large antenna installations also are undesirable for reasons of appearance and mechanical stability.

DISCLOSURE OF THE INVENTION

The invention, in one aspect, is directed to an antenna which is directional and also compact.

Therefore, the invention discloses a compact directional antenna arrangement comprising:

a spaced parallel array of antenna elements carried by a dielectric structure, the antenna elements being electrically connected to respective switching means, and the antenna arrangement being operable by the respective switching means to selectively switch one or more of the antenna elements to be active.

Preferably, the non-active radiating elements are switched by respective switching means to be either electrically connected to ground or in an open circuit condition. The driven elements can be monopoles or dipoles. An active monopole element can be physically sized to be resonant such that the reactive component of the antenna impedance is approximately zero.

Preferably, the antenna further comprises an earth plane arranged to be perpendicularly mounted to an end of the dielectric structure.

Preferably, the dielectric structure is regularly shaped, and most preferably is a cylinder. The driven elements can be arranged in a regular array.

Preferably, the relative dielectric constant, $\in_r$, is large. While $\in_r=10$ results in a very significant reduction in size, $\in_r=100$ is even more advantageous.

The radiating elements can be coupled to transceiver means by the switching means. The switching means can be switchably controlled by control means to selectively cause one or more of the radiating elements to be active in accordance with the direction of strongest received signal strength.

The invention also is directed to an antenna structure to protect the user of a portable communications device from excessive exposure to electromagnetic radiation.

Therefore, the invention further discloses a shielding structure for an antenna of a portable communications device, the structure comprising a sandwiched arrangement of, in order, a conductive sheet, a sheet of dielectric material and an antenna element, the shielded structure being arranged on the communications device so that the conductive sheet is closer to the user's head than the antenna element in use of the communications device.

Preferably, the shielding structure is planar, and the thickness of the dielectric sheet is less than $\lambda/(2\sqrt{\in_r})$, where $\in_r$ is the relative dielectric constant of the dielectric sheet, and $\lambda$ is the wavelength of the electromagnetic radiation to be received or transmitted by the antenna element.

The invention is further directed to a directional antenna, and thus discloses an antenna arrangement comprising an elongate antenna element carried by, and arranged to be parallel with the longitudinal axis of an elongate dielectric material, and in a manner to be eccentrically located with respect to the said longitudinal axis.

In another aspect the invention is directed to a directional and physically small antenna, and therefore further discloses a compact directional antenna arrangement comprising a spaced parallel array of antenna elements carried by a dielectric structure, one or more of the antenna elements being active, and the other antenna elements being passive and commonly connected to ground.

The invention yet further discloses a method of switching an antenna arrangement to achieve improved directionality, the antenna arrangement comprising a spaced parallel array of antenna elements carried by a dielectric structure, the method comprising the steps of:

selectively connecting one or more of the radiating elements by a respective switching means to be active;

measuring received signal strength for each selective connection of radiating elements; and maintaining the selective connection of the one or more radiating elements for the highest received signal strength.

Preferably, the method further comprises the step of periodically repeating the selective connection, measurement and maintaining steps.

Embodiments of the invention provide an antenna that is more efficient than those in the prior art, since there is a reduction in power consumption of the electronic equipment to which the antenna is coupled (e.g. a cellular telephone). This occurs for reason of there being less absorption by the user's head, increased signal strength due to improved directionality, less cross-polarisation and a minimal change in antenna impedance with the user's head position.

The antenna also will provide increased range, and offers improved performance under conditions of multi-path fading. There further is an associated health benefit, since the electromagnetic energy absorbed by the user's head is at a lower level than in the prior art.

One other specific advantage is that the antenna can be directly substituted for prior art antennas in portable communications devices. In one example, a physically smaller antenna having improved directivity can be substituted for an existing antenna in a cellular telephone. Thus the telephone casing can further be reduced in size to provide the user with greater portability.

BRIEF DESCRIPTION OF THE DRAWINGS

Embodiments of the invention will be described with reference to the accompanying drawings, in which:

FIG. 2(*a*) is a top view of a directional array antenna including a dielectric structure wherein the antenna elements are embedded in a dielectric structure.

FIG. 3(*a*) is a top view of a directional array antenna including a dielectric cylinder wherein the antenna elements are embedded in the dielectric cylinder.

BEST MODE FOR CARRYING OUT THE INVENTION

The embodiments will be described with reference to mobile cellular telecommunications. It is to be appreciated, however, that the invention equally is applicable to radio communications in general, including electromagnetic geophysics, radar systems and the like, as noted above.

One method of reducing the influence on reception and transmission performance of an antenna associated with a portable communications device by the user's head is to shield the antenna from the head. In prior art arrangements, however, a conductive sheet acting as a shield cannot be located closer than one quarter-wavelength from an antenna without degrading the efficiency of the antenna.

Figure 1A:
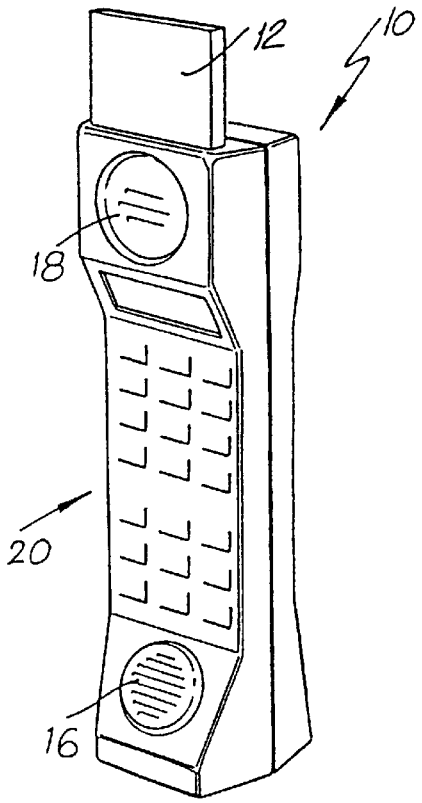
FIGS. 1*a*, 1*b* and 1*c* show a cellular telephone incorporating a shielded antenna structure.
Figure 1B:
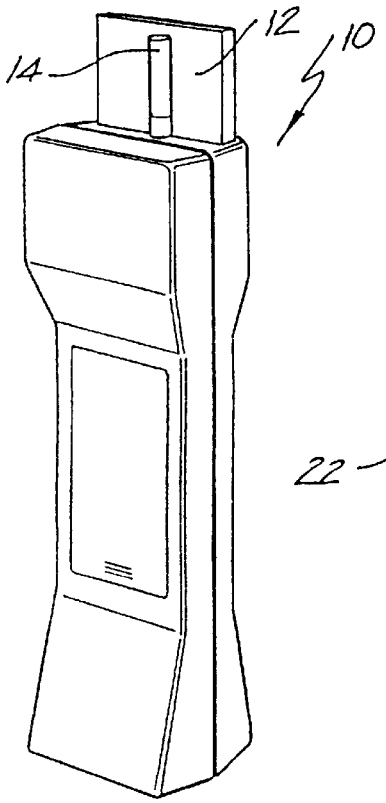
Figure 1C:
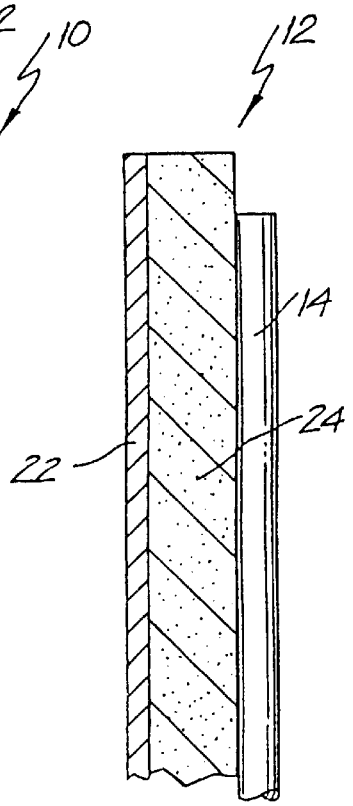

FIGS. 1*a*, 1*b* and 1*c* show a shielded antenna arrangement for a mobile telephone that allows the shield to be physically close to the antenna, contrary to prior art arrangements.

The antenna arrangement is constructed as a composite or sandwiched structure 12, as best shown in the partial cross-sectional view of FIG. 1*c*. The structure 12 comprises a conductive sheet 22, an intermediate layer of high dielectric constant low loss material 24 and a monopole antenna 14. The conductive sheet 22 typically is constructed of a thin copper sheet, whilst the dielectric material 24 typically is of alumina, which has a relative dielectric constant $\in_r > 10 \in_0$.

The conductive sheet 22 is located closest to the 'user' side of the mobile telephone 10, being the side having the microphone 16, earspeaker 18 and user controls 20, and therefore shields the user's head in use of the mobile telephone.

The effect of the dielectric material 24 is to allow the conductive back plane 22 to be physically close to the antenna 12 without adversely affecting the antenna's efficiency. By utilising a material with a relative dielectric constant $>10 \in_0$, and choosing the thickness of the dielectric material 24 to be $<\lambda/(2\sqrt{\in_r})$, the 'image' antenna is in phase with the radiating antenna 14 in the direction away from the conductive sheet 22. Thus the structure 12 has the effect of blocking the passage of electromagnetic radiation to the user's head in the vicinity of the antenna 14, and beneficially causing the reflected radiation to act in an additive manner to maximize received or transmitted signals.

The structure 12 can be mechanically arranged either to fold down onto the top of the mobile telephone 10, or to slidingly retract into the body of the telephone 10. The shielding structure also can be shaped as other than a flat plane; for example, it can be curved in the manner of half-cylinder.

Figure 2:
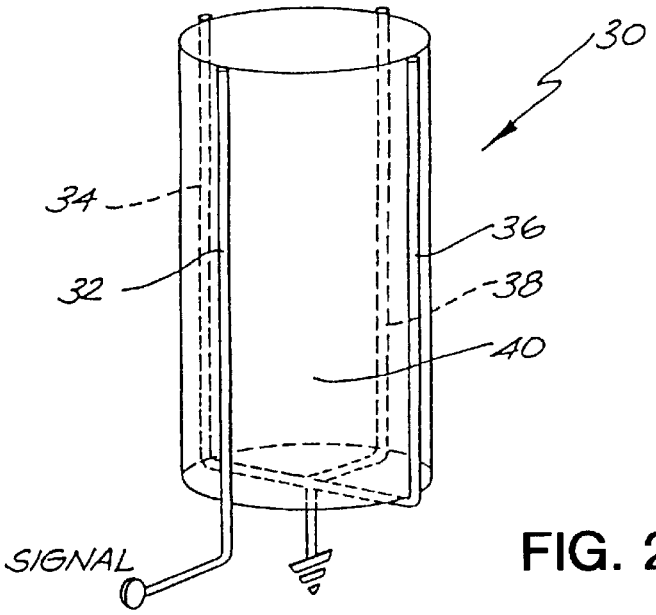
FIG. 2 shows a perspective view of a directional array antenna incorporating parasitic elements.
Figure 2A:
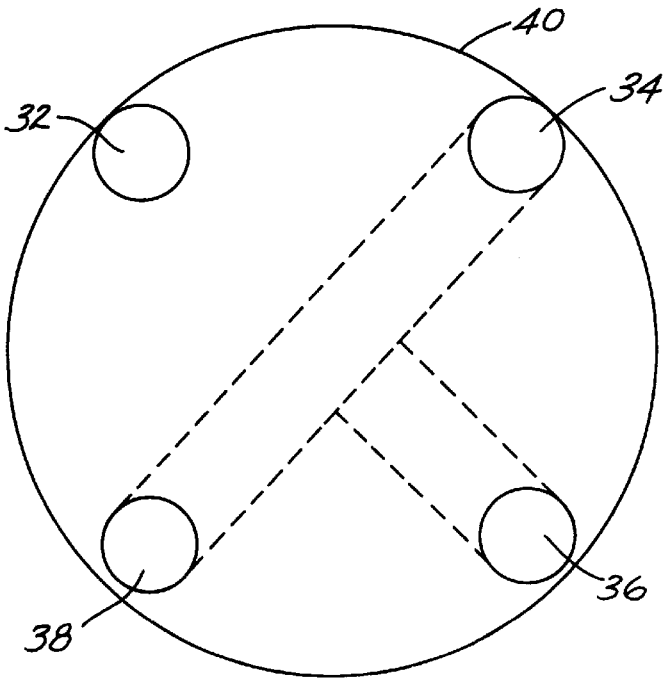

FIG. 2 shows an antenna arrangement 30 that can be used in direct substitution for known antenna configurations, for example, in cellular mobile telephones. The antenna 30 has four equally spaced quarter-wavelength monopole elements 32–38 mounted onto the outer surface of a dielectric cylinder 40. Most usually, the cylinder 40 will be solid.

Note also, that a shape other than a cylinder equally can be used. In a similar way, the elements 32–38 need not be regularly arranged. The only practical requirement is that the dielectric structure be contiguous. The elements 32–38 also can be embedded within the dielectric cylinder 40, or, for a hollow cylinder, mounted on the inside surface. For example, as illustrated in FIG. 2(*a*), the plurality of antenna elements 32, 34, 36, and 38 are embedded within the surface of the dielectric cylinder 40. What is important is that there be no air gap between each of the elements and the dielectric cylinder.

Only one of the monopole elements 32 is active for reception and transmission of electromagnetic radiation (RF signals). The other three monopole elements 34–48 are passive/parasitic, and commonly connected to ground. The antenna arrangement 30 exhibits a high degree of directivity in a radially outward direction coincident with the active element 32, with the three parasitic elements tending to act as reflector/directors for incident RF signals, as well as constituting a form of shielding. The scientific principles underpinning these performance benefits will be explained presently, and particularly with respect to the antenna configuration shown in FIG. 3.

The antenna 30 is suitable for use with mobile cellular telephones as noted above, and can be incorporated wholly within the casing of conventional mobile telephones. This is possible due to the antenna's reduced physical size (with respect to the prior art), and also permits direct substitution for conventional antenna configurations.

Size is an important design consideration in cellular telephones. A long single wire antenna (for example, an end feed dipole or a ¾ wavelength dipole antenna) distributes the RF energy so that head absorption by the user is reduced. The antenna also is more efficient due to a larger effective aperture. The longer the antenna is, however, the less desirable it is from the point of view of portability and mechanical stability. The antenna shown in FIG. 2 can achieve the same performance characteristics as the noted larger known types of antenna, but has the added advantage of being physically small.

Figure 3A:
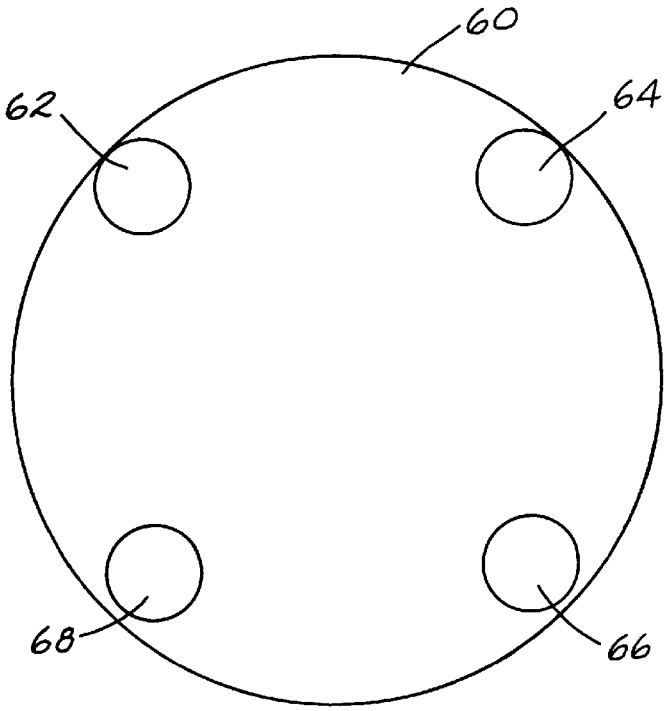
FIG. 3 shows a perspective view of a directional array antenna together with connected switching electronics.
Figure 3:
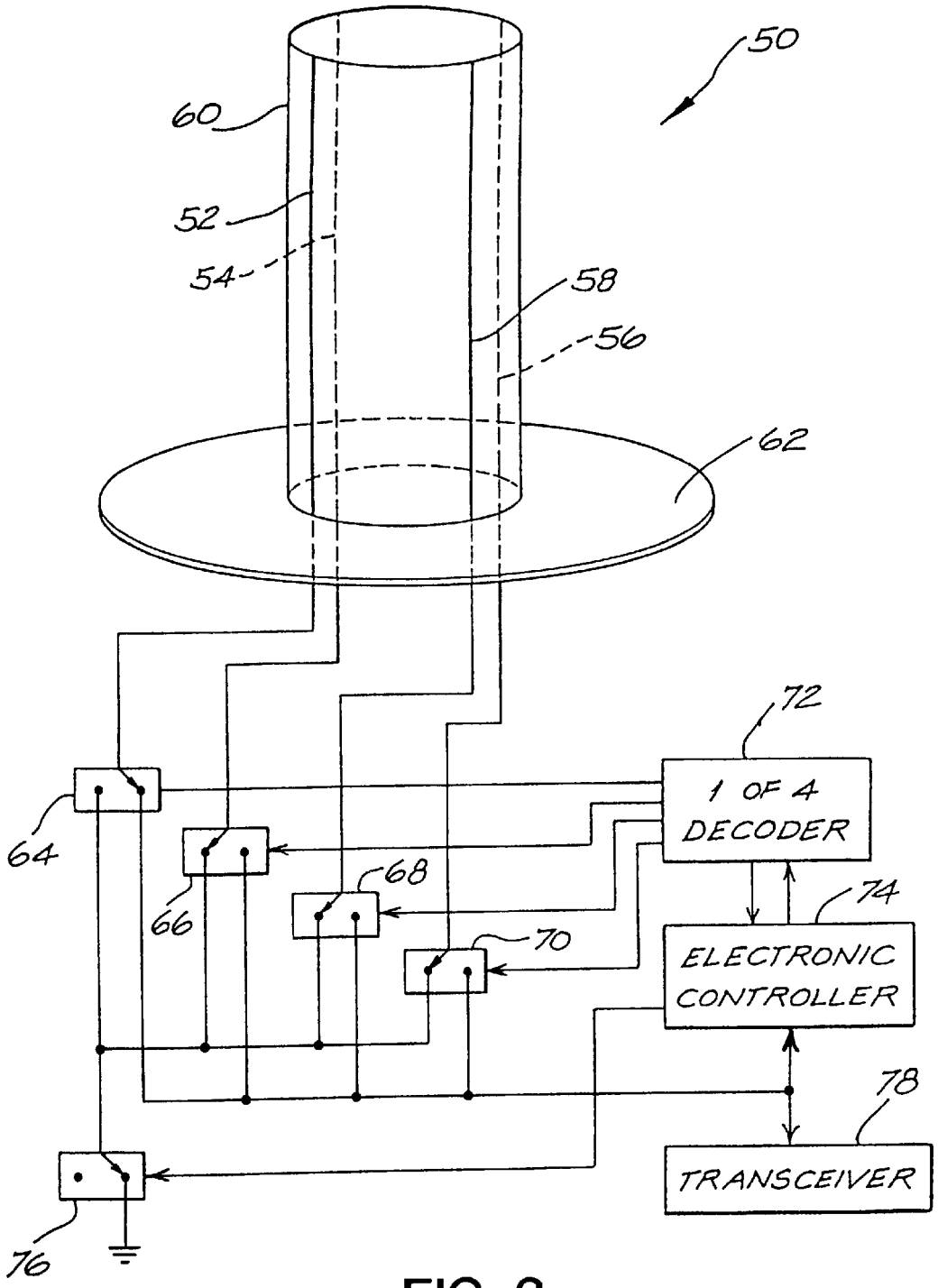

The antenna arrangement 50 shown in FIG. 3 has four equally spaced quarter-wavelength monopole elements 62–68 mounted on the outer surface of a solid dielectric cylinder 60. The monopoles 62–68 again can be embedded in the dielectric cylinder's surface, or the dielectric structure can be formed as a hollow cylinder and the monopole elements mounted to the inner surface thereof, although such an arrangement will have lower directivity since the relative dielectric constant of 1.0 of the air core will reduce the overall dielectric constant. For example, as illustrated in FIG. 3(*a*), the plurality of antenna elements 62, 64, 66, and 68 are embedded within or positioned on the inner surface of the dielectric cylinder 60.

The cylinder 60 is constructed of material having a high dielectric constant and low loss tangent such as alumina which has a relative dielectric constant $\in_r > 10\in_0$.

The monopoles 52–58 form the vertices of a square, viz., are in a regular array, and oriented perpendicularly from a circular conductive ground plane 62. The monopoles 52–58 lie close to the centre of the ground plane 62. The ground plane is not essential to operation of the antenna 50, but when present serves to reduce the length of the monopole elements.

A conductor embedded in a dielectric material has an electrical length reduced by a factor proportional to the square root of the dielectric constant of the material. For a conductor lying on the surface of an infinite dielectric halfspace with a relative dielectric constant $\in_r$, the effective dielectric constant, $\in_{eff}$, is given by the expression: $\in_{eff} = (1+\in_r)/2$.

If the conductor lies on the surface of a dielectric cylinder and parallel to its axis, and there are other conductive elements parallel to it, the effective dielectric constant is modified still further. Factors which influence the effective dielectric constant include the cylinders radius, and the number and proximity of the additional elements.

In the case of a relative dielectric constant, $\in_r = 100$, the length of the monopoles 52–58 can physically be reduced by the factor of approximately seven when the cylinder diameter is greater than 0.5 free space wavelengths. For example, for an antenna operating at 1 GHz, a quarter wavelength monopole in free air has a physical length of about 7.5 cm, however, if lying on the surface of a dielectric cylinder with $\in_r = 100$, the monopole can be reduced in physical size to about 1.1 cm.

Each of the monopoles 52–58 respectively is connected to a solid state switch 64–70. The switches are under the control of an electronic controller 74 and a 1-of-4 decoder 72 that together switch the respective monopoles. One of the monopoles 52 is switched to be active, whilst the rest of the monopoles 54–58 are switched to be commonly connected to ground by their respective switches 66–70 and the master switch 76. This, in effect, is the configuration shown in FIG. 2. The master switch 76 has a second switched state which, when activated, results in the non-active monopoles being short-circuited together without being connected to ground. In this configuration, the passive monopoles 54–58 act as parasitic reflector elements, and the antenna 50 exhibits a directional nature.

Directivity is achieved for a number of reasons. A conductor located some distance from the centre of a dielectric cylinder, yet still within the cylinder, has an asymmetrical radiation pattern. Further, passive conductors of a dimension close to a resonant length and located within one wavelength of an active element act as reflectors, influence the radiation pattern of the antenna and decrease its resonant length.

By appropriate changes in the length of monopole antennas, the input impedance and the directionality of the antenna 50 can be controlled. For example, for a two element antenna with one element active and the other element shorted to ground, for the smallest resonant length (i.e. when the reactance of the antenna is zero), the H plane polar pattern is similar to a figure of eight, providing the dielectric cylinder's radius is small. For antenna lengths marginally greater than this value, the front to back ratio (directivity) increases significantly.

In another configuration (not specifically shown), the passive monopoles 54–58 can be left in an open circuit condition. This effectively removes their contribution from the antenna (i.e. they become transparent). In this configuration, the antenna is less directional than if the monopoles 54–58 were shorted to ground (or even simply shorted altogether), however the antenna still provides significant directionality due to the dielectric material alone.

The dielectric cylinder 60 also increases the effective electrical separation distance. This is advantageous in terms of separating an active element from an adjacent passive element, which, if short circuited to ground, tends to degrade the power transfer performance of the antenna. Therefore, the effective electrical separation distance between the active monopole 52 and the diametrically opposed passive monopole 56 is given by $d/(\in_r)^{0.5}$, where d is equal to the diameter of the dielectric cylinder 60. The effective electrical separation distance between the active monopole 52 and the other passive monopoles 54,58 is given by $d/(2\in_r)^{0.5}$.

The dielectric cylinder 60 also has the effect of reducing the effective electrical length of the monopoles. This means that the mechanical dimensions of the antenna are smaller for any operational frequency than conventionally is the case; the electrical length and separation therefore are longer than the mechanical dimensions suggest. For an operational frequency of around 1 GHz, the size of the monopoles and dielectric cylinder are typically of length 1.5 cm and diameter of 2 cm respectively.

The antenna 50 shown in FIG. 3 also has the capability of being electronically steerable. By selecting which of the monopoles 52–58 is active, four possible orientations of a directional antenna can be obtained.

The steerability of the antenna 50 can be utilised in mobile cellular telecommunications to achieve the most appropriate directional orientation of the antenna with respect to the present broadcast cell site. The electronic controller 74 activates each monopole 52–58 in sequence, and the switching configuration resulting in the maximum received signal strength is retained in transmission/reception operation until, sometime later, another scanning sequence is performed to determine whether a more appropriate orientation is available. This has the advantage of conserving battery lifetime and ensuring maximum quality of reception and transmission. It may also reduce the exposure of a user of a mobile telephone to high energy electromagnetic radiation.

The sequenced switching of the monopoles 52–58 can be done very quickly in analogue cellular telephone communications, and otherwise can be part of the normal switching operation in digital telephony. That is, the switching would occur rapidly enough to be unnoticeable in the course of use of a mobile telephone for either voice or data.

Examples of theoretical and experimental results for a number of antenna arrangements now will be described.

Arrangement A

Figure 4:
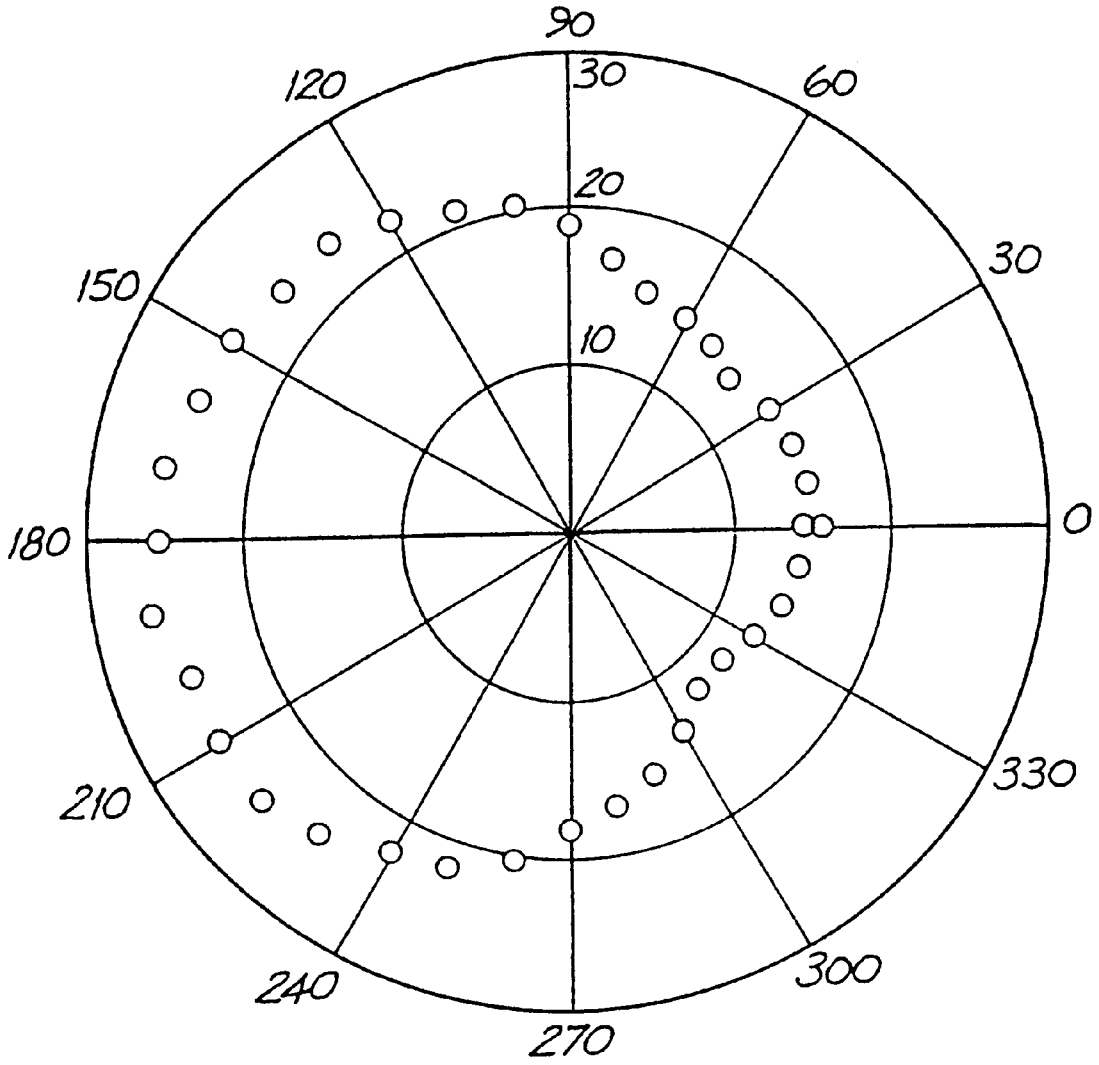
FIG. 4 shows a polar pattern for a limiting configuration of the antenna shown in FIG. 3.

FIG. 4 shows an experimental polar plot of an eccentrically insulated monopole antenna. This is a configuration having a single conductor eccentrically embedded in a material having a high dielectric constant. It could, for example, be constituted by the antenna of FIG. 2 without the three grounded parasitic conductors 34–38. The radial axis is given in units of dB, and the circumferential units are in degrees.

The RF signal frequency is 1.6 GHz, with a diameter for the dielectric cylinder of 25.4 mm and a length of 45 mm. The relative dielectric constant is 3.7. As is apparent, the front-to-back ratio (directivity) of the antenna is approximately 10 dB.

Arrangement B

This arrangement utilises a simplified antenna structure over that shown in FIG. 2. The antenna has two diametrically opposed monopole elements (one active, one shorted to ground) on an alumina dielectric cylinder ($\in_r$=10) having a diameter of 12 mm. The length of each monopole is 17 mm for the first resonance.

Figure 5:
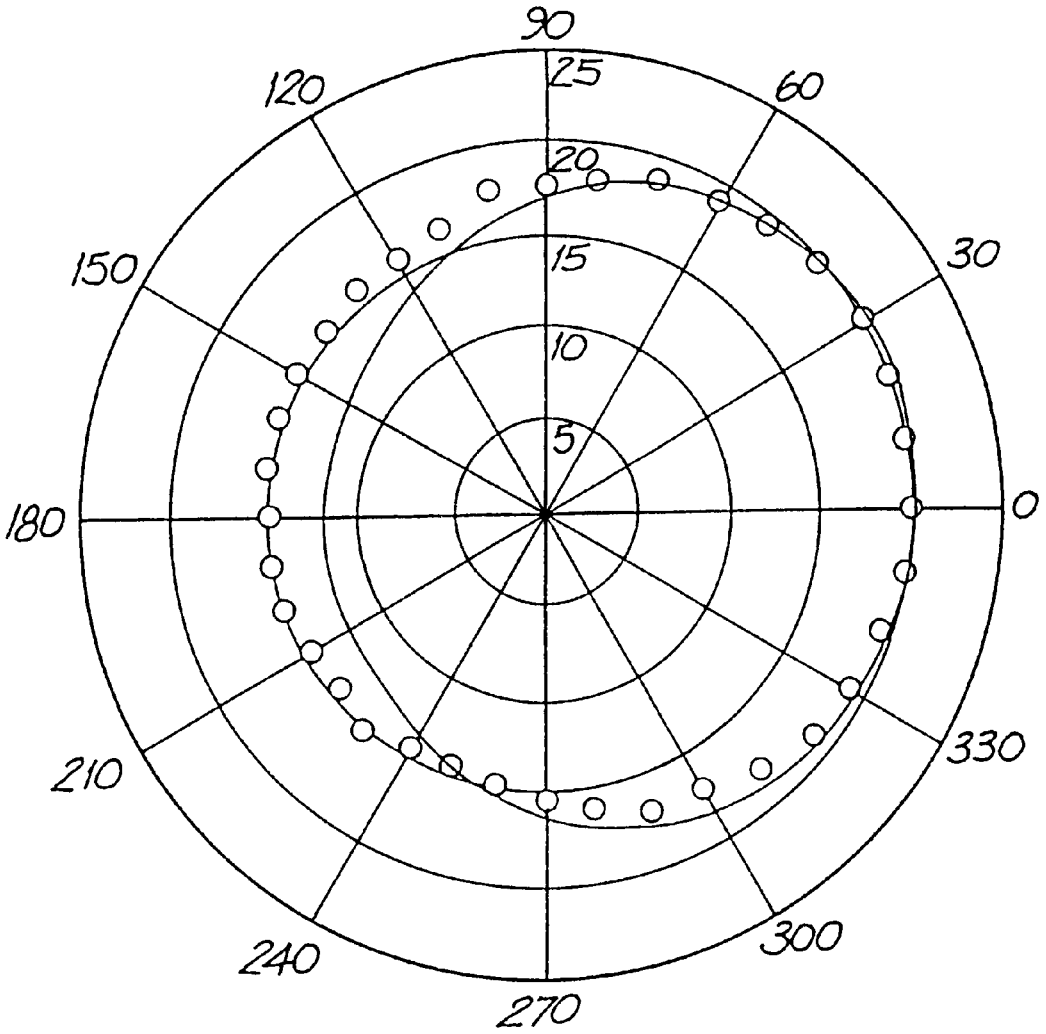
FIG. 5 shows a polar pattern for a modified form of the antenna shown in FIG. 3.

FIG. 5 shows both the theoretical and experimental polar patterns at 1.9 GHz for this antenna. The radial units are again in dB. The theoretical plot is represented by the solid line, whilst the experimental plot is represented by the circled points. At this frequency, the antenna has a front to back ratio of 7.3 dB.

Arrangement C

Figure 6:
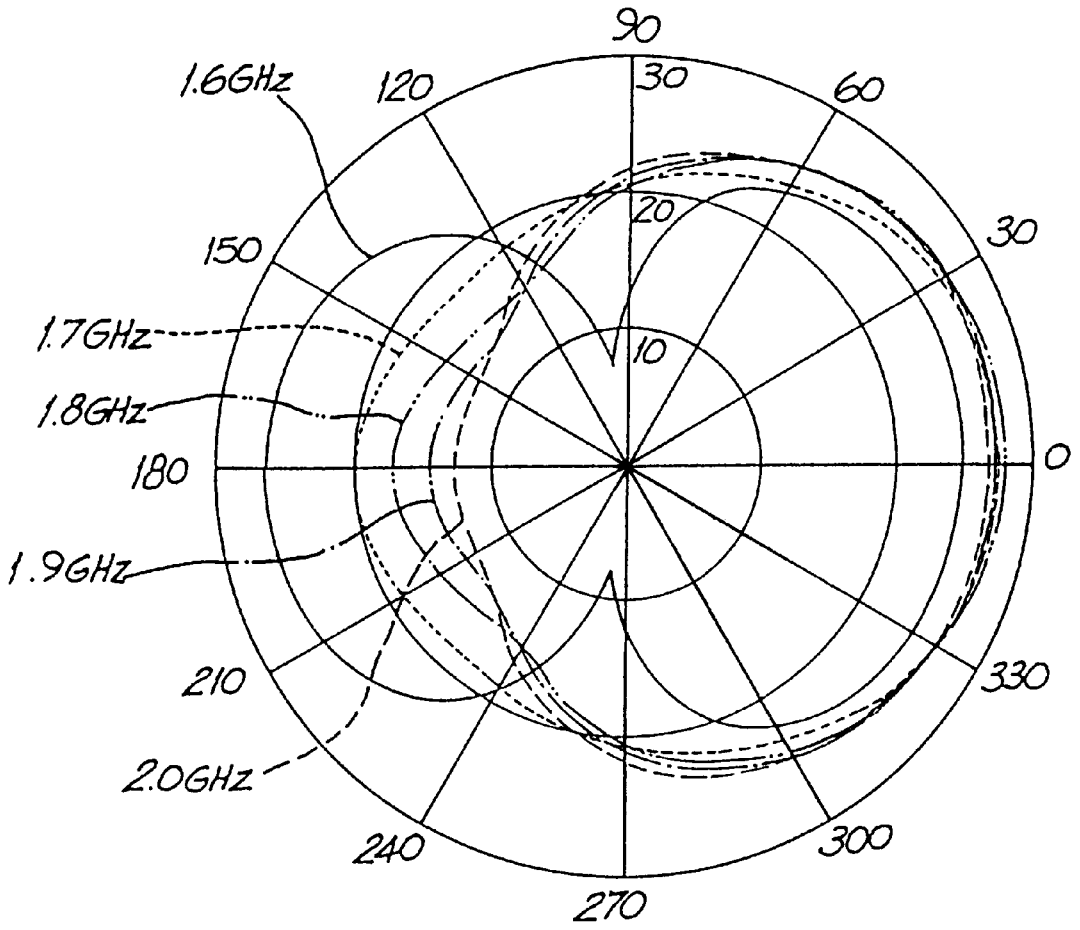
FIG. 6 shows a polar pattern for a particular switched arrangement of the antenna shown in FIG. 3.

A four element antenna can be modelled using the Numerical Electromagnetics Code (NEC). FIG. 6 shows theoretical NEC polar results obtained as a function of frequency for a four element cylindrical antenna structure similar to that shown in FIG. 2 (i.e. one active monopole and three passive monopoles shorted to ground). The cylinder diameter is 12 mm, the length of the monopole elements is 17 mm and the relative dielectric constant $\in_r$=10.

Note that at 1.6 GHz the antenna is resonant and the polar pattern is a figure of eight shape. For frequencies greater than this, the antenna front-to-back ratio (directivity) becomes larger. This effect also can be induced by increasing the dielectric constant or increasing the diameter of the antenna.

Arrangement D

Figure 7:
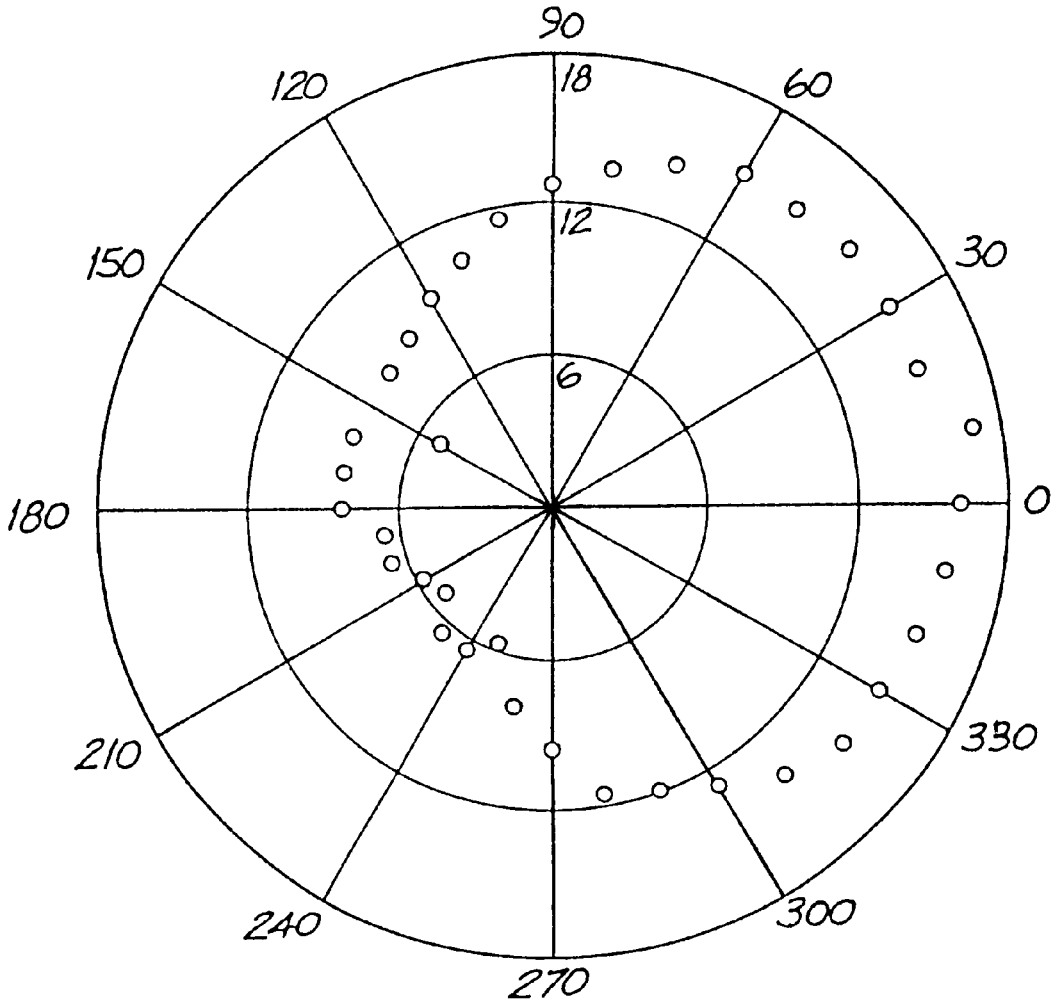
FIG. 7 shows a polar pattern for another switched arrangement of the antenna shown in FIG. 3.

FIG. 7 shows experimental data at a frequency of 2.0 GHz for a four element antenna having the same dimensions as those noted in respect of FIG. 6, which is in general agreement with the corresponding theoretical plot shown in FIG. 6.

In another application relating to ground probing radar, radar transceivers utilise omnidirectional antennas to receive echoes from objects lying within a 180° arc below the position of the antenna. As a traverse is conducted, each object appears with a characteristic bow wave of echoes resulting from side scatter.

Figure 8:
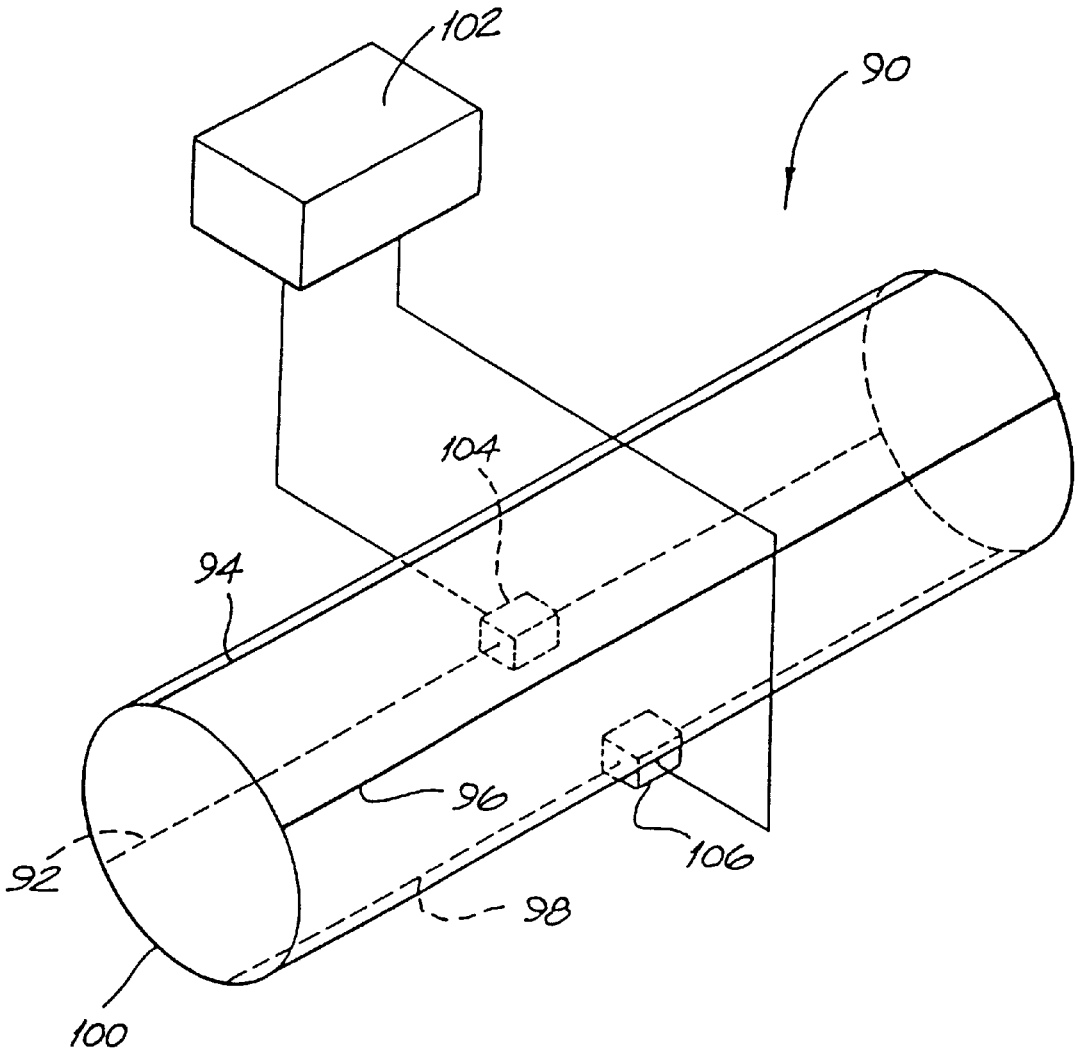
FIG. 8 shows a further embodiment relating to ground probing radar.
Figure 9:
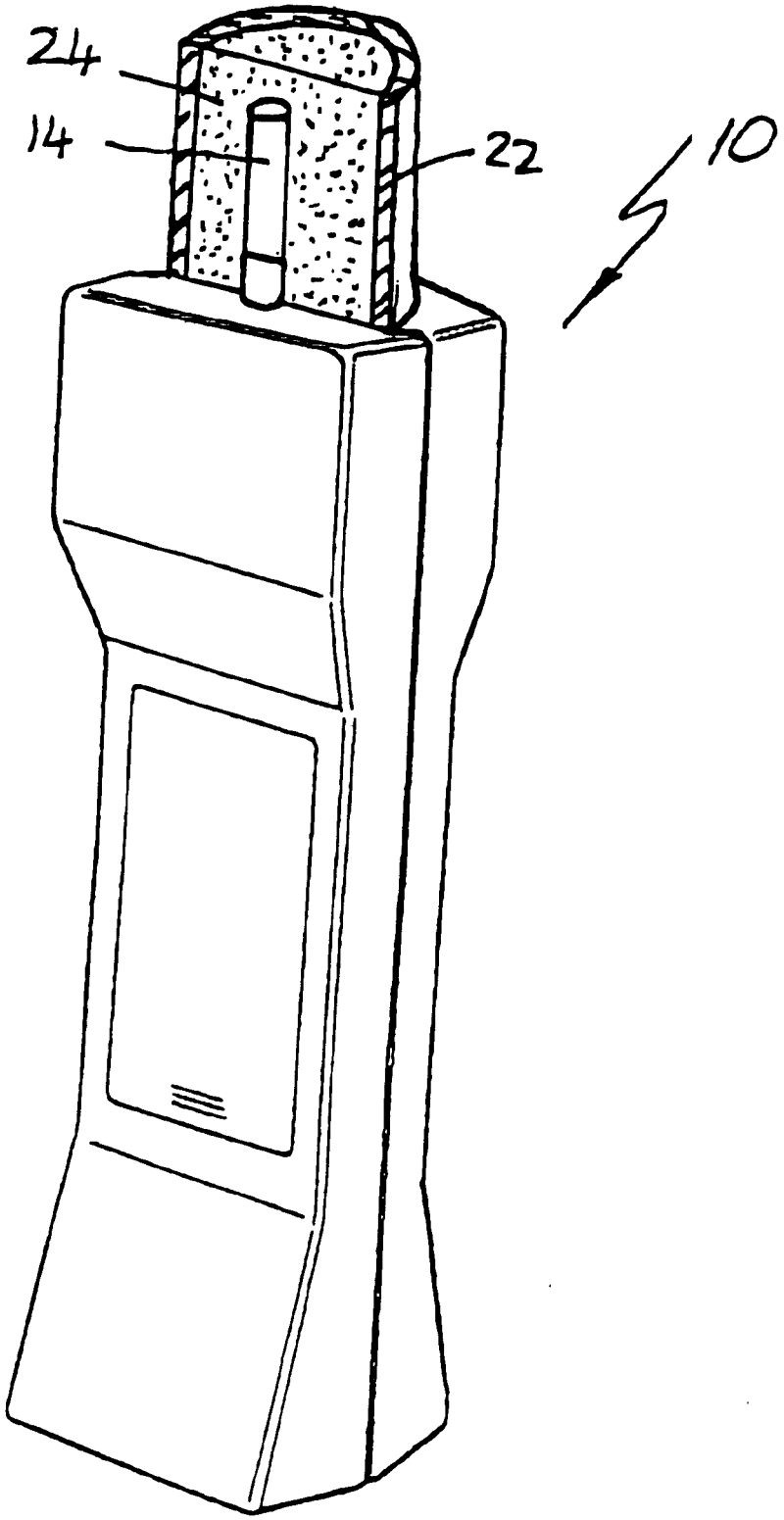
FIG. 9 is a perspective view of a single monopole wire element mounted in a dielectric half cylinder surrounded by a shield according to an embodiment of the present invention.

Another embodiment of an antenna configuration particularly suited for use in ground probing radar is shown in FIG. 8. The antenna 90 incorporates four dipole elements 92–98 arranged on, and fixed to, a dielectric cylinder 100. In this instance no conductive ground plane is required.

In the conduct of ground probing radar studies, two directional orientations of the antenna 90 are used. This is achieved by controlled switching between the driven dipole elements 92,96. Switching is under the control of the electronic controlling device 102 illustrated as a 'black box', which controls the two semiconductor switching elements 94,96 located at the feed to the driven dipole elements 92,96. In operation, either driven dipole 92,96 is switched in turn, with the other remaining either open circuit or short circuited to ground. The passive dipole elements 94,98 act as parasitic reflectors, as previously discussed.

By utilising the two switched orientations of the antenna 90 in conducting ground probing radar measurements, the effects of side scatter can be minimised mathematically with processing. This results in improved usefulness of the technique, and particularly improves in the clarity of an echo image received by reducing the typical bow wave appearance.

Numerous alterations and modifications, as would be apparent to a person skilled in the art, can be made without the departing from the basic inventive concept.

For example, the number of antenna elements is not be restricted to four. Other regular or irregular arrays of monopole or dipole elements, in close relation to a dielectric structure, are contemplated.

We claim:

1. A directional antenna arrangement comprising:

a dielectric structure having a surface;

a non-planar array of wire antenna elements located parallel to the surface of the dielectric structure, the antenna elements embedded within or positioned on the surface of the dielectric structure; and switching means electrically connected to the antenna elements, the antenna arrangement being operable by the switching means to selectively switch one or more of the antenna elements to be active, the non switched antenna elements being parasitic.

2. The antenna arrangement as claimed in claim 1, wherein the parasitic antenna elements are switched by the switching means either to be electrically connected to ground or in an open circuit condition.

3. The antenna arrangement as claimed in claim 2, wherein the antenna elements are arranged in a symmetric array.

4. The antenna arrangement as claimed in claim 3, wherein the dielectric structure is a cylinder.

5. The antenna arrangement as claimed in claim 4, wherein the cylinder is either solid or hollow.

6. The antenna arrangement as claimed in claim 3, wherein the dielectric structure is a rectangular body.

7. The antenna arrangement as claimed in claim 2, wherein the switching means are selectively controlled by control means to cause one or more of the antenna elements to be active in accordance with the direction of greatest received signal strength.

8. The antenna arrangement as claimed in claim 2, wherein the relative dielectric constant of the dielectric structure is greater than $\in_0$, where $\in_0$ is the permittivity of free space.

9. The antenna arrangement as claimed in claim 8, wherein the antenna elements are separated by a minimum distance of $$\frac{\lambda_o}{10} \cdot \frac{1}{\sqrt{\varepsilon_r}}$$

where $\lambda_0$ is the wavelength in free space of the electromagnetic radiation to be received or transmitted by the antenna elements, and $\in_r$ is the relative permittivity of the dielectric structure.

10. The antenna arrangement as claimed in claim 9, wherein the length of the antenna elements is greater than $$\frac{\lambda_o}{5} \cdot \frac{1}{\sqrt{\varepsilon_r}}.$$

11. A shielding structure for the antenna of a portable communications device, the structure comprising the sandwiched arrangement of a reflective element, a dielectric material and an antenna array comprising an array of parallel wire elements, ones of which are active and the others of which are parasitic, the shielding structure being arranged so that the reflective element is closer to a user's head than the antenna element in use in the communications device.

12. The shielding structure as claimed in claim 11, wherein the thickness of the dielectric material is less than $\lambda/(2\sqrt{\in_r})$.

13. The shielding structure as claimed in claim 11, wherein the reflective array comprises one or more conductive sheets.

14. The shielding structure as claimed in claim 11, wherein wire elements are electrically connected to switching means to selectively switch said wire elements to be active or parasitic.

15. The shielding structure as claimed in claim 11 and that is planar.

16. The shielding structure as claimed in claim 11 and that is formed as a half cylinder.

17. A directional antenna arrangement comprising:

a dielectric cylinder having a surface;

a non-planar symmetric array of wire antenna elements located parallel to the surface of the dielectric cylinder and positioned within or on the surface of the dielectric cylinder; and switching means connected to the antenna elements, the antenna arrangement being operable by the switching means to selectively switch one or more of the antenna elements to be active, the non-switched antenna elements being parasitic.

18. The antenna arrangement as claimed in claim 17, wherein the parasitic antenna elements are switched by said switching means either to be electrically connected to ground or in an open circuit condition.

19. The antenna arrangement as claimed in claim 17, wherein the antenna elements are separated by a minimum distance of $$\lambda_o \frac{1}{10\sqrt{\varepsilon_r}}$$

where $\lambda_0$ is the wavelength in free space of the electromagnetic radiation to be received or transmitted by the antenna elements, and $\in_r$ is the relative permittivity of the dielectric structure.

20. The antenna arrangement as claimed in claim 17, wherein the length of the antenna elements is greater than $$\lambda_o \frac{1}{5\sqrt{\varepsilon_r}}.$$

21. A directional antenna arrangement comprising:

a dielectric structure having a surface;

at least one wire antenna element located within or on the surface of the dielectric structure, each antenna element being arranged to be parallel with, and offset from, a longitudinal axis of the dielectric structure; and switching means electrically connected to each antenna element, the switching means being controllable to selectively switch an antenna element to be either active or parasitic.

22. The antenna arrangement as claimed in claim 21, wherein the switching means is further controllable to switch each parasitic antenna element either to be electrically connected to ground or in an open circuit condition.

* * * * *